US005784758A

United States Patent [19]

Carrick

[11] Patent Number: 5,784,758

[45] Date of Patent: Jul. 28, 1998

[54] LOW PROFILE SELF-LATCHING KNIFE HINGE

[75] Inventor: Joseph Carrick, San Marcos, Calif.

[73] Assignee: Youngdale Manufacturing Corp., Vista, Calif.

[21] Appl. No.: 825,977

[22] Filed: Apr. 4, 1997

[51] Int. Cl.[6] ..... E05D 11/10

[52] U.S. Cl. ..... 16/335; 16/332; 16/321

[58] Field of Search ..... 16/335, 331, 332, 16/334, 344, 336, 321

[56] References Cited

U.S. PATENT DOCUMENTS

| | | | |
|---|---|---|---|
| 539,741 | 5/1895 | Ingram | 16/335 |
| 3,203,031 | 8/1965 | Youngdale et al. | 16/321 |
| 3,432,879 | 3/1969 | Gorton et al. | 16/335 |
| 4,329,759 | 5/1982 | Lautenschlarger | 16/335 |
| 5,060,344 | 10/1991 | Cress | 16/335 |
| 5,392,493 | 2/1995 | Youngdale | 16/321 |

FOREIGN PATENT DOCUMENTS

| | | | |
|---|---|---|---|
| 288398 | 11/1967 | Australia | 16/335 |

*Primary Examiner*—Chuck Mah
*Attorney, Agent, or Firm*—John J. Murphey, Esq.; Murphey Law Offices

[57] ABSTRACT

A hinge for mounting a door for swinging between open and closed positions on a frame, the hinge including a door and frame wings mountable to the door and frame, respectively, a pivot interconnecting the wings to permit swinging of the door between the open and closed positions, a latching finger disposed in close spaced-opposing relation with the door wing and having first and second ends and including a large bend intermediate the first and second ends to provide spring action thereto, a second smaller reverse bend formed at the first distal end and arranged for overlapping engagement with a locking edge formed on the door wing, and a tab formed on the finger spaced-apart from the second bend for insertion into a cut-out formed on the door wing spaced-apart from the locking edge to steady the finger in connection with the door wing, the simultaneous overlapped engagement of the reverse bend and insertion of the tab in the cut-out providing significant locking power to the finger in the door wing; the second end of the finger extending toward the frame wing and having a cam formed thereon spaced-apart from the frame wing when the door is in the open position, a cam surface formed on the frame wing, opposite the cam, engageable with the cam to force the second distal end of the finger to swing away from the door wing as the door is swung toward the door-closing position, and a pocket in the cam surface adjacent the cam surface, the cam on the second distal end of the finger snapping resiliently toward the door wing and into the pocket as the door reaches the closed position and thereafter coacting with the pocket to latch the door releasably in the closed position.

8 Claims, 3 Drawing Sheets

LOW PROFILE SELF-LATCHING KNIFE HINGE

BACKGROUND OF THE INVENTION

1. Field of the Invention

This invention relates to a hinge for mounting a door, such as a cabinet door, to a frame, such as a cabinet, for swinging the door between open and closed positions. More particularly, this invention pertains to a knife hinge that is fully concealed from the front of the cabinet, that has a low internal profile so as not to interfere with storage activity in the cabinet, and that utilizes smaller wing plates than other such plates in the prior art.

2. Description of the Prior Art

The design of many cabinets requires that the cabinet door hinges not be observable from the front of the cabinet. Hinges of this type exist and a class of them is referred to as "knife hinges." These knife hinges comprise door and frame wings for mounting to the door and frame, respectively, a pivot interconnecting the wings to permit swinging of the door between open and closed positions and a latching finger disposed in spaced-opposing relation with the door wing having a first or fixed end and a second or movable free end, and where the wing opposite the latching finger includes one or more cam surfaces that are engageable with the second or free end of the finger to force the second portion of the finger to swing away from the door as the door is swung toward the closed position and then seat tightly against the door wing when the door has reached the closed position. This type of hinge holds the door in a yieldingly closed position under pressure from the latching finger in combination with the aforesaid cam surfaces.

One of these knife hinges is disclosed in U.S. Pat. No. 3,203,031. This disclosure shows a hinge that is a self-closing and latching hinge in that it includes a mechanism for automatically closing the door as the door approaches the closed position and for thereafter releasably holding the door in the closed position. This hinge utilizes a metal torsion spring and plastic roller held in place by means of a rivet. Unfortunately, this hinge is relatively expensive to manufacture due to multiple components and assembly requirements.

Another knife hinge is disclosed in U.S. Pat. No. 5,060,344 and utilizes an integrally molded door component and resilient spring mechanism to provide similar closing and latching functions. This hinge is less expensive to assemble, but not as strong due to the material used for the door wing. In addition, the door wing needs to be quite long to support the integral resilient spring mechanism and this extends the hinge over the door wing, thereby limiting its use to cabinets having large door wings. The latching finger, made integral with the door wing, is of necessity quite high in profile, in order to have sufficient strength to pull the door closed during the last stages of door closure. This high profile extends into the interior of the cabinet to interfere with stacking operations in the cabinet interior.

Efforts to lower the profile of the latching fingers have met with failure because of two general problems. The first is that the plastic used in the finger requires a large profile to be able to close the cabinet with sufficient closure power. The second is that the latch finger becomes de-stabilized as its width and front profile are reduced. Opening and closing a cabinet door places a significant strain on these small hinges so that they must be ruggedly constructed to keep from being deformed during use. The narrower the latch finger is made, the more it tends to wobble from side-to-side during flexing. Additional metal bracketing added to stabilize the finger only adds to the cost of fabrication and assembly and thus nullifies the savings of going to a smaller finger.

There is accordingly a need for a lower profile knife hinge with a smaller door wing that is overall simpler and less expensive to make and assemble so as to provide the public with lower cost cabinet components without a concomitant loss in quality.

SUMMARY OF THE INVENTION

This invention is a small profile knife hinge that overcomes all of the problems hereinbefore set forth in the prior art. The hinge requires overall smaller door and frame wings so that it finds use in cabinets both large and small. The latch finger has a significantly lower vertical profile so that it does not intrude into the interior of the cabinet to disrupt cabinet activity. The latch finger is not monolithic with the door wing, but is independent thereof and is attached to the door wing through a unique arrangement that provides high strength to the latch and stability during opening and closing of the cabinet door.

The invention is a hinge for mounting a door for swinging between open and closed positions on a frame, such as a cabinet, wherein the hinge comprises door and frame wings mountable on the door and frame, respectively, a pivot interconnecting the wings to permit swinging of the door between an open and closed position, a latching finger disposed in spaced-opposing relationship with the door wing and having first and second end portions, the first end portion of the finger having a reverse bend formed therein for lapping over a locking edge formed on the door wing and having a tab formed thereon inward from the first end for insertion into a cut-out formed in the door wing spaced-apart from the locking edge, to steady the finger in connection with the door wing, and being fixedly mounted thereto so as to permit the second end portion of the finger to swing cantilever fashion toward and away from the door wing, the finger being made of resiliently yieldable plastic, a post molded integrally with and extending from the second end portion of the finger and engaging the door wing to limit movement of the finger toward the door wing, the second end portion of the finger extending toward the frame wing and having a free end, the frame wing including a cam having a cam surface engageable with the free end of the latching finger to force the second portion of the finger to swing away from the door wing as the door is swung toward the closed position, and a pocket formed in the cam adjacent the cam surface thereof, where the free end portion of the finger snaps resiliently toward the door wing and into the pocket as the door reaches the closed position and thereafter coacts with the pocket to latch the door releasably in the closed position.

Accordingly, the main object of this invention is a knife hinge that has a low interior profile and is adaptable to large and small cabinets. Other objects of the invention include a knife hinge where the latching finger is stabilized against wobbling during opening and closing of the cabinet door; a knife hinge where the latching finger is not monolithic with the door wing; a knife hinge that is lower in cost in manufacturing and assemble and is adaptable to having the door wing made smaller than those of the prior art, so that it may be used on cabinet doors that are small in comparison to other doors used in cabinetry.

These and other objects of the invention will become more apparent when reading the description of the preferred embodiment along with the drawings that are appended hereto. The protection sought by the inventor may be gleaned from a fair reading of the claims that conclude this specification.

DESCRIPTION OF THE PREFERRED EMBODIMENTS

Figure 1:
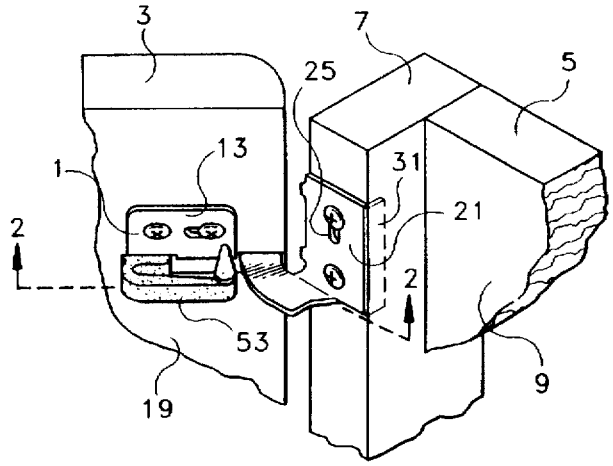
FIG. 1 is a perspective view of the cabinet hinge of this invention shown mounted on a cabinet.

Turning now to the drawings wherein elements are identified with numerals and like elements are identified with like numerals throughout the 9 figures, FIG. 1 shows the preferred embodiment of this invention of a knife hinge 1 located between a cabinet door 3 in hinged connection with an underlying frame such as a cabinet frame 5. A front cabinet frame member 7 is attached about the perimeter and outside surface 9 of said cabinet frame 5 by glue, screws, nails or other known fastening devices for mounting part of knife hinge 1 thereagainst.

Figure 2:
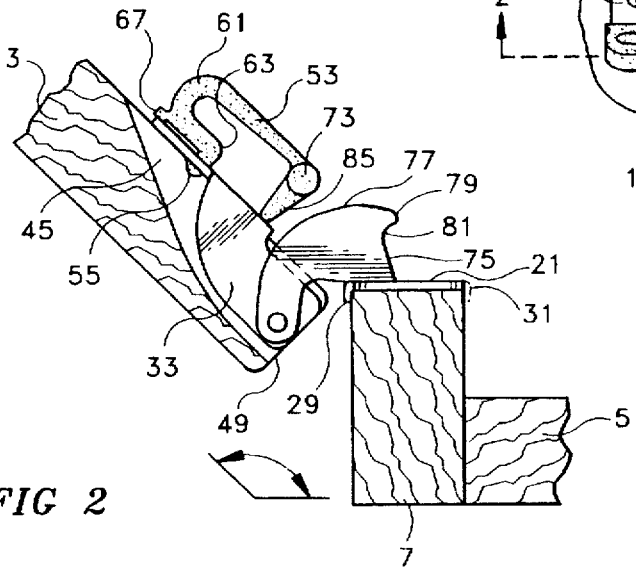
FIG. 2 is a sectional view taken along lines 2—2 in FIG. 1.
Figure 3:
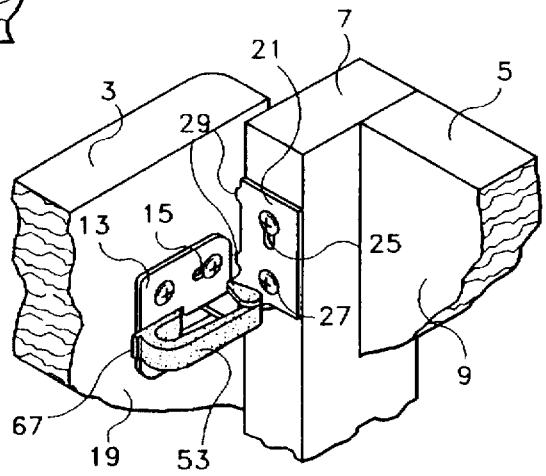
FIG. 3 is a perspective view of the cabinet hinge of the invention similar to FIG. 1, but taken with the door in the closed position.
Figure 4:
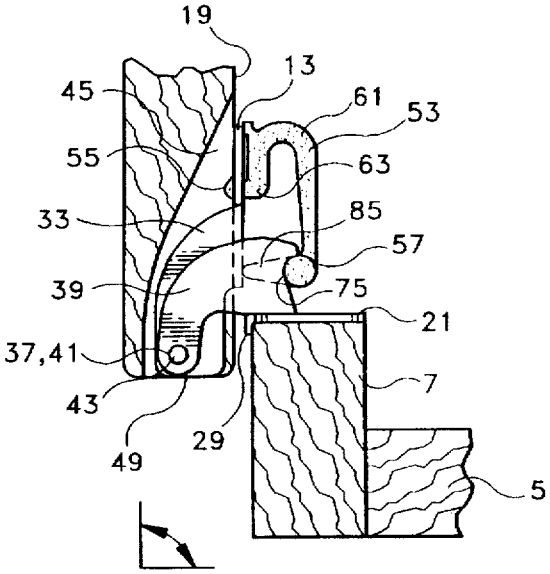
FIG. 4 is a bottom plan view of the hinge shown in FIG. 3.

Cabinet door 3 is usually an upright door that swings horizontally from a closed position against cabinet frame 5 as shown in FIGS. 3 and 4, to an open position shown in FIG. 2. However, cabinet door 3 may be made to swing upward or downward and knife hinge 1 is useful for these doors as well.

As shown in the Figures, knife hinge 1 comprises a door wing 13 (see FIGS. 1, 3, 5, and 9) preferably stamped out of metal and of a generally rectangular shape, having formed therethrough two slots 15 and a hole 17 in mutual spaced-apart arrangement for receipt therethrough of screws to fasten said wing 13 against the inside surface 19 (see FIGS. 1, 3, 5, and 9) of cabinet door 3.

Figure 7:
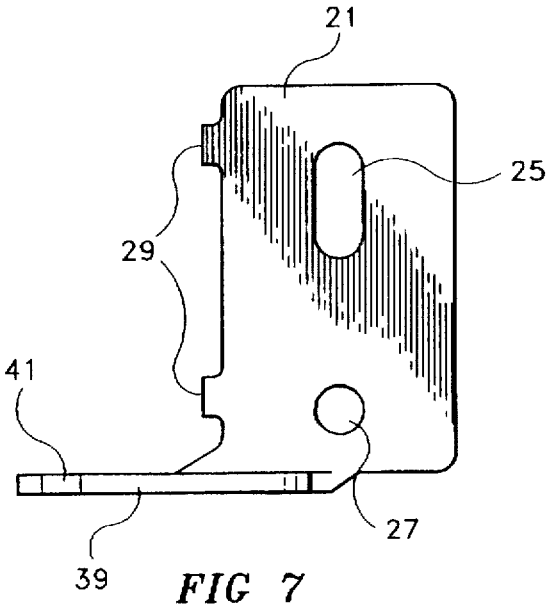
FIG. 7 is an elevational view of the frame wing of the hinge as seen from the inboard edge surface of the cabinet frame.
Figure 8:
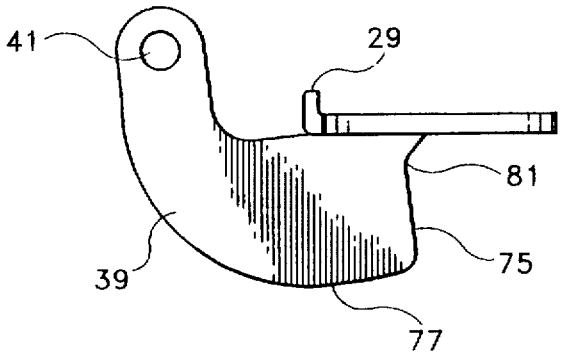
FIG. 8 is a top plan view of the frame wing.

As shown in FIGS. 7 and 8, a frame wing 21 is also provided that is also preferably rectangular in overall outline and stamped from metal and has formed therethrough a slot 25 and a hole 27 for receipt of screws there-through to mount said wing 21 against front frame member 7. A pair of tabs 29 extend from the outer edge of frame wing 21 to steady wing 21 on front cabinet frame member 7. As shown in FIGS. 1 and 2, in another embodiment of this invention, an additional attachment aid in the form of a flap 31, of the same metal making up frame wing 21, is shown (in dotted outline) extending from the opposite outer edge of frame wing 21 around the corner of said front frame member 7 to provide additional steadying support to frame wing 21. When cabinet door 3 is opened, door wing 13 and frame wing 21 form an interior angle greater than 90°, as shown in FIG. 2; when in the closed position, cabinet frame 5 and door wing 3 swing into a 90° angle as shown in FIG. 4.

Figure 5:
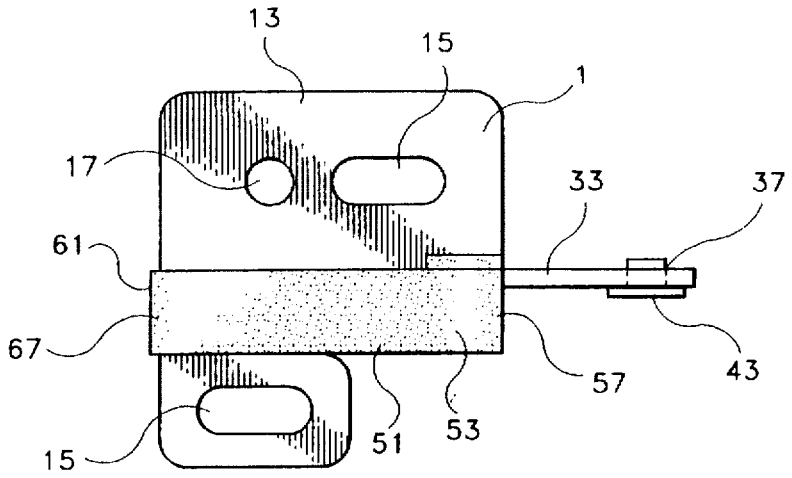
FIG. 5 is an elevational view of the door wing of the hinge as seen from the inside surface of the cabinet door.
Figure 6:
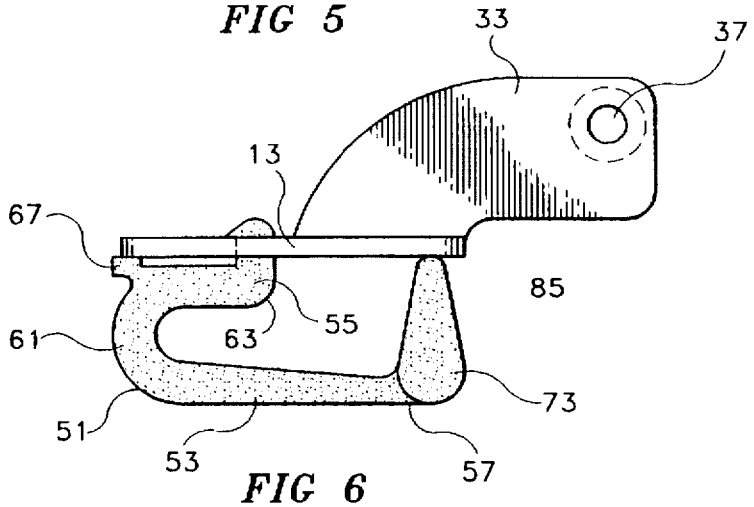
FIG. 6 is a top plan view of the door wing.
Figure 9:
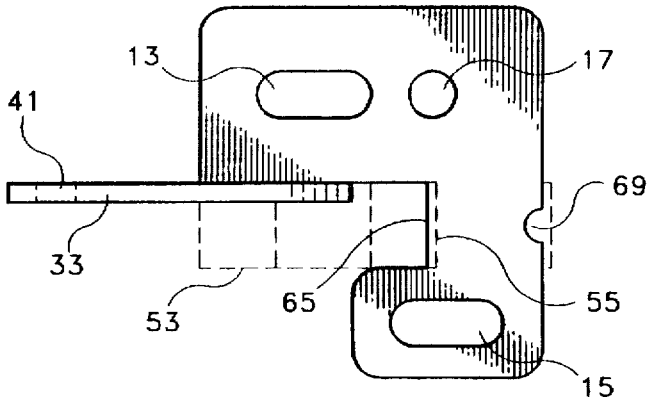
FIG. 9 is an elevational view of the door wing of the hinge as seen from the outside surface of the cabinet door with the latching finger of the self-latching mechanism added in dotted outline.

As shown in FIGS. 5, 6, and 9 formed integrally with and projecting forwardly from the lower margin of door wing 13 is a first ear 33, which is disposed at right angles or normal to the plane of door wing 13 and frame wing 21 and is otherwise in the horizontal plane when knife hinge 1 is properly mounted on an upright swinging door. An aperture 37 is formed in the free end portion of first ear 33. As shown in FIGS. 7 and 8, a second ear 39 is formed integrally with and projecting forward from the lower side margin of frame wing 21 and also is disposed at right angles to the plane of frame wing 21 so that it is also in the horizontal plane when cabinet door 3 is hung vertically on cabinet frame 5. As shown in FIG. 4, an aperture 41 is formed in the free end portion of second ear 39 such that when door wing 13 and frame wing 21 are mounted on front frame member 7 and inside surface of door wing 13, respectively, apertures 37 and 41 are in face-to-face juxtaposed alignment such that a rivet 43 may be mounted therein and hold the parts together in pivotal interconnection.

As shown in FIGS. 2 and 4, a slot 45 is formed in inside door surface 19 of cabinet door 3 and opens out of the edge 49 of cabinet door 3. First and second ears 33 and 39 of wings 13 and 21 are located in slot 45 as is rivet 43. The entire hinge is concealed from the front of cabinet door 3 when door 3 is closed over cabinet frame 5 and only a small portion of the hinge is visible from the hinged edge 49 of the door. Hinge 1 is provided with a self-locking mechanism 51 (see FIGS. 5, 6 and 9) for holding door 3 releasably in the closed position. It is in this self-latching mechanism where the benefit lies over the prior art. As the door is open and closed, first and second ears 33 and 39 scissor back and forth across each other in conventional manner of knife hinges.

As shown in FIGS. 2, 4 and 6, self-latching mechanism 51 is provided in the form of a latching finger 53 of terminal length that is disposed in close space opposing relation with door wing 13 and is preferably held parallel to wing 13 and apart therefrom a short distance such as about 1.3 cm. Finger 53 is terminate by first and second distal ends 55 and 57, respectively. A first large bend 61, of approximately 180°, is formed in finger 53 intermediate ends 55 and 57 and provides the spring action for second end 57 as will be more fully explained later.

A second smaller reverse bend 13 is formed at first distal end 55 and arranged for overlapping or hooking engagement with said door wing 63 about a locking edge 65 formed in door wing 13. A tab 67 is formed on the outside surface of finger 53, intermediate first bend 61 and second bend 63, and extends outward from the outer surface of finger 53, to repose in a cut-out 69 formed in door wing 13 spaced-apart from said locking edge 65. Finger 53 preferably takes the form of a J-shaped element with a substantially long straight portion, between first bend 61 and second distal end 57, that acts as a spring body. Because of this straight element, it may lie very close to door wing 13 and not interfere with stacking or storing of goods or other items in the cabinet. Finger 53 is preferably made of plastic and is injection molded.

The simultaneous hooking of reverse bend 63 over locking edge 65 and insertion of tab 67 and cut-out 69 provide significant locking power for finger 53 in door wing 13. In addition, both reverse bend 63, engaged with locking edge 65, and tab 67, engaged in cut-out 69, relieve side stresses on finger 53 to reduce wobble therein when cabinet door 3 is open and closed.

As shown in FIGS. 2, 4, 6 and 8, second distal finger end 57 is formed into a round cam 73 that rides against a camming surface 75 preferably formed in second ear 39. Camming surface 75 has a first ramp surface 77 against which cam 73 rides as cabinet door 3 is swung from open position to closed position, said action forcing cam 73 to move apart from door 3 and placing a stress on latching finger 53. A rather sharp bend 79 formed in ear 39 divides first ramp surface 77 from a second camming surface or pocket 81 that is generally normal to first ramp surface 77. Cabinet door 3 is positioned slightly outboard of the surface of front frame member 7 such as about 4 mm so that second finger end 57 rides onto second camming surface 81 to force door 3 into a yieldably closing position against said member 7. This co-action between cam 73 and pocket 81 makes cabinet door 3 remain closed until enough pulling force is exerted on door 3 to overcome the bias pressure of cam 73.

Having latching finger 53 made from plastic and door wing 13 made from metal means that a smaller vertical profile can be formed in finger 53 and yet the force of said finger can be made significant enough to provide adequate door closing power.

A post 85 is formed on finger second distal end 57 that extends toward door wing 13. This provides a stop to finger 53 so that it does not force second distal end 57 into contact with door wing 13 and ruin the action of hinge 1.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

what is claimed is:

1. A hinge for mounting a door for swinging between open and closed positions on a frame, said hinge comprising:

a) a door and frame wings mountable to the door and frame, respectively;

b) a pivot interconnecting said wings to permit swinging of said door between said open and closed positions;

c) a latching finger disposed in close spaced-opposing relation with said door wing and having first and second distal ends and including a large bend intermediate said first and second ends to provide spring action thereto;

i) a second smaller reverse bend formed at said first distal end and arranged for overlapping engagement with a locking edge formed on said door wing; and, ii) a tab formed on said finger spaced-apart from said second bend for insertion into a cut-out formed on said door wing spaced-apart from said locking edge to steady said finger in connection with said door wing, said simultaneous overlapped engagement of said reverse bend and insertion of said tab in said cut-out providing significant locking power to said finger in said door wing;

d) said second end of said finger extending toward said frame wing and having a cam formed thereon spaced-apart from said frame wing when said door is in the open position;

e) a cam surface formed on said frame wing, opposite said cam, engageable with said cam to force said second distal end of said finger to swing away from said door wing as the door is swung toward said door-closing position; and, f) a pocket in said cam surface adjacent said cam surface, said cam on said second distal end of said finger snapping resiliently toward said door wing and into said pocket as the door reaches said closed position and thereafter coacting with said pocket to latch the door releasably in the closed position.

2. The hinge of claim 1 wherein said latching finger is made of plastic and is independent of said door wing.

3. The hinge of claim 1 further including a post molded integrally with and extending from said second distal end of said finger and engaging said door wing to limit movement of said finger toward said door wing.

4. The hinge of claim 1 further including a flap extending from the outer edge of said frame wing around the corner thereof for placement against the frame member to provide additional steadying support to said frame wing.

5. A hinge for mounting a cabinet door for swinging between open and closed positions on a cabinet frame and for holding said cabinet door in a yieldingly closed position against said cabinet, said hinge comprising:

a) a door wing mountable to the inside surface of the cabinet door;

b) a frame wing mountable to a front cabinet frame member that is attached about the perimeter and front face of said cabinet frame;

c) first and second ears formed integrally with and projecting forwardly from the lower margin respectively of said door wing and said frame wing, said ears arranged normal to the respective planes of said door wing and said frame wing so as to reside in mutual adjacent juxtaposition;

d) said first and second ears being pivotally interconnected, to permit swinging of said door between said open and closed positions, such that when the door is opened and closed said ears scissor back and forth in normal knife hinge manner;

e) a latching finger disposed in close spaced-opposing relation with said door wing, defined by first and second distal ends, and including a large bend intermediate said first and second ends to provide spring action;

i) a second smaller reverse bend formed at said first finger distal end and arranged in overlapping engagement with a locking edge formed on said door wing; and, ii) a tab formed on said finger spaced-apart from said second bend for insertion into a cut-out formed on said door wing spaced-apart from said locking edge to lock said finger in stable connection with said door wing, said simultaneous overlapped engagement of said reverse bend and insertion of said tab in said cut-out providing significant locking power to said finger in said door wing;

f) said second distal end of said finger extending toward said frame wing and having a cam formed thereon spaced-apart from said frame wing when said door is in the open position;

g) a cam surface formed on said second ear, opposite said cam and engageable with said cam during closing of the door, to force said second distal end of said finger to swing away from said door wing as the door is swung toward the door-closing position; and, h) a pocket formed in said second ear, adjacent said cam surface, wherein said cam on said second distal end of said finger snaps resiliently toward said door wing and into said pocket as the door reaches its closed position against the cabinet and thereafter said pocket and said cam coacting to latch the door releasably in the closed position.

6. The hinge of claim 5 wherein said latching finger is made of plastic and is independent of said door wing.

7. The hinge of claim 5 further including a post molded integrally with and extending from said second distal end of said finger and engaging said door wing to limit movement of said finger toward said door wing.

8. The hinge of claim 5 further including a flap extending from an outer edge of said frame wing around the corner thereof for placement against said front cabinet frame member to provide additional steadying support to said frame wing.

* * * * *